US011571057B2

(12) United States Patent
Daugherty

(10) Patent No.: US 11,571,057 B2
(45) Date of Patent: Feb. 7, 2023

(54) NAIL CLIPPER WITH THIN ANGLED WRAP-AROUND COVER-GUARD

(71) Applicant: Charles Richerd Daugherty, Las Vegas, NV (US)

(72) Inventor: Charles Richerd Daugherty, Las Vegas, NV (US)

( * ) Notice: Subject to any disclaimer, the term of this patent is extended or adjusted under 35 U.S.C. 154(b) by 0 days.

(21) Appl. No.: 17/443,146

(22) Filed: Jul. 21, 2021

(65) Prior Publication Data

US 2022/0031041 A1 Feb. 3, 2022

Related U.S. Application Data

(60) Provisional application No. 62/706,423, filed on Aug. 15, 2020, provisional application No. 63/057,302, filed on Jul. 28, 2020.

(51) Int. Cl.
*A45D 29/02* (2006.01)

(52) U.S. Cl.
CPC ..... *A45D 29/02* (2013.01)

(58) Field of Classification Search
None
See application file for complete search history.

(56) References Cited

U.S. PATENT DOCUMENTS

| | | | | |
|---|---|---|---|---|
| 3,812,868 | A * | 5/1974 | Keating | A45D 29/02 132/75.4 |
| 4,982,747 | A * | 1/1991 | Shah | A45D 29/02 132/75.4 |
| 5,918,375 | A * | 7/1999 | Rossi, III | A45D 29/02 33/485 |
| 10,420,409 | B1 * | 9/2019 | Crolley | A45D 29/02 |
| 2013/0327348 | A1 * | 12/2013 | Ashur | B26B 29/04 132/73.6 |
| 2017/0325567 | A1 * | 11/2017 | Nikaran | A45D 29/02 |
| 2022/0031041 | A1 * | 2/2022 | Daugherty | A45D 29/02 |

FOREIGN PATENT DOCUMENTS

WO WO 2022/026983 A1 * 2/2022

* cited by examiner

*Primary Examiner* — Hwei-Siu C Payer
(74) *Attorney, Agent, or Firm* — Dale Jensen, PLC; Dale Jensen

(57) ABSTRACT

As shown in one preferred embodiment, a two-blade vice-type nail clipper comprising a thin safety-cover-guard with ergonomic upward angle and wrap-around safety edges, that is permanently mounted just below said nail clipper's lower cutting blade and that follows or mirrors the shape of said nail clipper's lower cutting surface, including wrapping around the sharp sides, corners and edges of said lower cutting surface, so as to provide an industry advancing level of nail cutting safety with minimal invasiveness.

7 Claims, 7 Drawing Sheets

NAIL CLIPPER WITH THIN ANGLED WRAP-AROUND COVER-GUARD

INCORPORATION BY REFERENCE TO RELATED APPLICATIONS

This invention claims priority from U.S. Provisional Application No. 63/057,302 which was filed on 28 Jul. 2020, and U.S. Provisional Application No. 62/706,423 which was filed on 15 Aug. 2020. Each of the aforementioned applications is incorporated by reference herein in its entirely, and each is hereby expressly made a part of this specification.

GLOSSARY FOR EXAMINER

Terms listed in order of relevance:

Safety-cover-guard: Inventor's preferred term to refer to invention described in this application and in the preferred embodiment. It is to be understood that the words 'cover-guard' may be substituted for the words 'safety-cover-guard', and that other generic applicable words such as, but not limited to 'safety shield' or 'safety guard' or 'protective shield' may be freely substituted within the spirit and intent of the present invention.

'Wrap-around' feature: Inventor's preferred term to generally describe how the far ends of said safety-cover-guard physically wrap around a nail clipper's sharp and dangerous sides, a key and unique advancement provided by said safety-cover-guard's novel design.

User: The person physically operating a nail clipper during the nail cutting process.

End-user: The person whose nails are being cut; either by someone else or themselves.

Finger or Fingernail: For the sake of brevity and obviousness, the use of the words 'finger' or 'fingernail' within this application should be understood to also refer to and include 'toe' and 'toenail' respectively. Let it be on record that present invention works properly on and is intended for fingernails and toenails.

Blade(s): Let it be on record throughout this application that when referring to a nail clipper's cutting blade(s), the words 'cutting surface' or other similar terms may be freely substituted. Said terms are to refer to the part(s) of a nail clipper that do the cutting but not specifically to any particular means or method of doing said cutting.

Attached: Let it be on record that when using the word 'attached' to refer to said safety-cover-guard being physically and permanently joined together on the body of a nail clipper, that there are a multitude of words that may be freely substituted, such as but not limited to, 'mounted', 'mounted to', 'joined to', 'added to', 'molded to' 'affixed to' or 'bonded to'; as 'attached' is not referring to a particular mechanical or manufacturing process of attaching said safety-cover-guard to a nail clipper, but rather to generically refer to the nail clipper and safety-cover-guard being properly affixed together, regardless of method of doing so. Any method of attaching said cover-guard to said nail clipper should be deemed within the spirit, scope and intent of the present invention.

Host nail clipper: A nail clipper of any style that would have the present invention, a safety-cover-guard, attached to itself in a manner appropriate for that said nail clipper.

Lateral Nail Fold: The areas around a finger nail or toe nail where said nail and flesh share three common and permanent borders. The two borders on either side of said nail are highly susceptible to being cut or injured during the nail cutting process. The present invention's wrap-around bumper-style safety guard now provides a unique and efficient remedy to protect against cuts and injuries to this important but previously neglected vulnerable area of finger flesh.

BACKGROUND OF INVENTION

The present invention relates to the general field of nail clippers, primarily in the area of nail clipper safety and more specifically, in the field of reducing cuts, injuries and stress commonly experienced and associated with current un-safe nail clippers during the nail cutting process.

Despite numerous attempts over the past century, the nail clipper industry has failed to offer consumers en masse a safe and commercially accepted solution for the style of nail clippers preferred by consumers en masse, the common two-surface vice-type nail clipper as depicted in the preferred embodiment described herein. Tens of millions of children, seniors in need of care, mentally & physically handicapped individuals of all ages who cannot care for themselves, parents, home-care workers, those with medical conditions such as diabetes, as well as the entire nail salon industry would benefit from the novel remedies offered by the present invention. Inventor states that proper weight be given to the fact that after one hundred and forty years of failed safety attempts, the common two-blade vice-style nail clipper most commonly preferred by consumers en masse still offers no safety solution, to this day, and that the present invention provides a remedy not previously known not only for consumers en masse, but for the nail clipper industry as well. The present invention brings the common nail clipper into the twenty first century.

Previous nail clipper safety attempts offered by the nail clipper industry have resulted in nail clippers that are cumbersome, inefficient, not practical or desirable to use, unrecognizable, frightful looking or in still other ways, found to be unpopular or unacceptable by consumers en masse. These previous failed attempts have resulted in the common two-blade vice-style nail clipper being just as dangerous today as it was one hundred and forty years ago. There has been no prior proposed remedy that has either earned the trust of consumers en masse, or that has advanced the common two-blade vice-style nail clipper into the twenty first century. More importantly, this means children, seniors, handicapped people and nail salon customers are still being injured, and stress is still common for those who have to cut the nails of another person. Because no innovative and popular safety solution to this problem exists, a remedy is needed by the industry and by the public, and is now offered by the present invention.

Sharp corners and edges: The nail clipper industry does not offer consumers a remedy that addresses and solves the problems created by a nail clipper's sharp corners and edges, focusing instead on the front cutting blades or surfaces only, which only addresses part of the reason nail clippers cause cuts and injuries. By not solving the problem of those injuries caused by a nail clipper's sharp corners and edges especially when cutting nails at difficult angles, and by not offering direct protection from said sharp corners and edges, previous safety devices fail to deliver the level of safety offered by the present invention.

Advanced means to pry up nail and simultaneously have said nail in cutting position: The common two-blade vice-style nail clipper preferred by consumers en masse offers no way to perform this function. A unique feature of the present invention occurs when a difficult, diseased, injured or torn nail needs to be pried upward in order to be cut with a nail clipper. With the present invention, the safety-cover-guard pries up the nail, and while holding the nail in that position, the nail clipper's blades are automatically already in perfect position to cut that area of the nail. This is a unique feature of said safety-cover-guard not known before.

Background conclusion: The present invention in its preferred embodiment offers consumers en masse an ergonomic, intuitive and novel remedy not previously available. The need for the remedy offered by the present invention is long standing. Inventor states the present invention, based on its unique design and small footprint could become the industry standard for all nail clippers going forward. The nail clipper industry has left consumers en masse with no safety protection at all for their preferred two-blade vice-type nail clipper, despite one hundred and forty years of failed attempts. The present invention is a unique and novel safety remedy for a century-old problem.

SUMMARY OF THE INVENTION

The preferred embodiment is a two-blade vice-style nail clipper comprising a thin, bumper-like-in-appearance safety-cover-guard that is permanently formed to or attached to said nail clipper below said nail clipper's lower cutting blade, and which follows or mirrors the general shape of said lower cutting blade, continuing around or wrapping around the sharp sides, corners and edges of said lower cutting blade, offering an advanced level of nail clipper protection not known before. Said safety-cover-guard is also permanently formed or attached at a unique upward angle, which allows said safety-cover-guard to perform multiple important functions, such as but not limited to providing an end-user with maximum skin protection beneath a finger nail, with minimal invasiveness during the nail cutting process. It is understood that modifications could be made while still keeping within the scope and spirit of the present invention. The following paragraphs offer expanded insight on specific and novel elements offered by the present invention.

Sharp and dangerous sides, corners and edges of nail clipper are now neutralized:

Expanding on the first aspect, the sharp corners and unsafe edges of the common two-blade vice-style nail clipper are safely neutralized by said safety-cover-guard's unique inclusive wrap-around design. The wrap-around bumper-style design of preferred embodiment provides an end-user protection from said dangerous sharp sides, corners and edges and thus provides a remedy not previously offered to consumers en masse on a two-blade vice-style common nail clipper.

Unique thinness of safety-cover-guard:

Expanding on the first aspect, previous nail clipper safety options are bulky, inefficient, non-user-friendly and often unrecognizable and mostly undesirable by consumers en masse. The present invention's thinness and small visible footprint is a key to its ability to perform multiple important functions efficiently and intuitively with least effort and maximum results, such as but limited to, working in concert with said safety-cover-guards upward angle to provide a minimally invasive safety solution.

Unique upward angle provides minimal invasiveness:

Expanding on the first aspect, the present invention's novel upward angle allows for said safety-cover-guard to perform multiple key functions, including providing maximum safety during the nail cutting process but uniquely with minimal invasiveness. Said upward angle is designed to work ergonomically with the curves of the human fingertip, which allows said nail safety-cover-guard to easily, efficiently and more importantly, intuitively slide above the vulnerable flesh found under a finger nail or toe nail with little or no contact with said flesh. Less contact with flesh translates to a more sanitary, safer, less physically obtrusive and more natural intuitive nail cutting experience.

Unique upward angle provides novel method to pry upward difficult nails:

Expanding on the first aspect, the novel upper angle also provides an excellent means of conveniently prying under a difficult nail, while simultaneously and intuitively placing the nail clipper into cutting position. A novel aspect of the present invention is that when the safety cover-guard is used to pry a difficult nail upward, the very act of doing so automatically and intuitively places the blades of a nail clipper into cutting position, in one motion, with no other type of finger file or second device needed. Prying a difficult nail upward is pointless if a nail clipper's blades are not then in position to perform cutting. The present invention uniquely remedies this problem by allowing a thin, ergonomic way to slide under a difficult nail, pry it up, and yet end up with the nail clipper's cutting blades in proper place to begin cutting said difficult nail. This is a remedy not previously offered.

Unique upward angle provides instant method to clean under a nail: Expanding on the first aspect, the upper angle also provides the user with an efficient and instant means of cleaning under a nail, scraping away dead skin under a nail or aiding in the removing of splinters without needing to stop the nail cutting process and open a separate nail clipper attachment. Thus, the present invention allows users to simultaneously perform normal nail cutting, pry up difficult nails as needed throughout the process and perform cleaning duties all with the same said safety-cover-guard. This results in an all-inclusive nail cutting process that can now be done quicker and safer. Such a remedy has not previously been made available to consumers en masse on their preferred two-blade vice-style nail clipper.

Upward angle provides minimal contact with flesh: Expanding on the first aspect, because the human finger or human toe is curved, the tip of the finger or toe extends further out than does the flesh directly under the nail, in a curving manner. The angled guard of the preferred embodiment allows for said safety-cover-guard to slip under said nail and above said tip flesh area in a manner that eliminates the need to touch, push or shove back flesh. Previous safety attempts offered on other nail clippers physically touch, push away, or shove back areas of flesh, which is counter intuitive, inefficient, completely unnecessary, and now with the present invention, outdated.

Upward angle provides most efficient method of preventing a nail from being cut too short: Expanding on the first aspect, said unique upward angle novel working in concert with the present invention's intentional thinness, provides a most efficient means of preventing a nail from being cut too short unintentionally. When said safety-cover-guard is placed under a finger further than is necessary to perform its intended functions, the end-user would feel said safety-cover-guard physically coming into contact with areas under the finger that are not meant to be cut. Rephrased, a nail clipper without said safety-cover-guard can be unintentionally inserted under a fingernail to a much more dangerous depth than a nail clipper with wrap-around style, thin bumper guard. At that deepest point of unintentional insertion under a finger nail, a nail clipper without said safety-cover-guard is extremely dangerous, and the present invention is revolutionarily safe, performing its' unique safety benefits even deep under a finger nail, a remedy not previously known.

Strategic placement of safety-cover-guard: Expanding on the first aspect, the preferred embodiment's unique upward angle is made possible because of where said safety-cover-guard is intentionally mounted to the lower body of a nail clipper. Positioning said safety-cover-guard just below a nail clipper's lower cutting blade allows said safety-cover-guard to now have enough room to be angled upward so as to be able to perform its' intended functions, but not block the cutting blade. Mounting the safety-cover-guard in said position allows for the most ergonomic and intuitive way for said safety-cover-guard to be quickly and safely placed under a nail.

Minimally invasive: Expanding on the first aspect, the preferred embodiment provides a considerably less physically invasive method of protecting an end-user from cuts and injuries than previously known. By unique design, covering vulnerable flesh with a thin safety-cover-guard means nearly no flesh under a finger nail or toe nail is touched, pushed away or forced backwards. It is counter productive to block, push or force backwards any amount of finger or toe flesh when the purpose and intent of placing a finger or toe nail into a clipper is to move said nail closer to the nail clipper or have the nail clipper move forward to the said nail. Nail clippers using that failed approach actually force the entire finger away from the nail clipper, creating unnecessary pressure or force between finger and nail clipper, thus actually increasing the odds of an accidental cut happening. By sliding the preferred embodiment's thin safety-cover-guard under an end-user's nail and above the flesh of the fingertip, a level of minimal invasiveness not previously known is remedied by the present invention.

Low profile, small footprint: Expanding on the first aspect, the preferred embodiment of present invention provides a more advanced, ergonomic and higher level of safety solution that is barely noticeable after being attached to a host nail clipper. After being offered cumbersome, often unrecognizable and certainly non-practical safety solutions for the past one hundred and forty years, consumers en masse now have a functioning, ergonomic and intuitive safety device on the preferred common two-blade vice-style nail clipper that is so small it may not even be recognized at first by some consumers. To provide such an advanced and intuitive safety solution with such a small footprint is indeed a novel remedy made possible by the present invention.

Familiarity: Expanding on the first aspect, the preferred embodiment of the present invention offers consumers a solution designed specifically for the nail clipper style they most prefer and purchase, the common two-blade vice-style nail clipper. Less drastic change is always preferred by consumers when it comes to their favorite products. The present invention provides a superb safety solution to their preferred style of nail clipper without changing said nail clipper into an unrecognizable, non-user-friendly nail clipper with additional parts and unfamiliar gadgets attached. Such a cumbersome or non-user friendly nail clipper by its own design defeats the purpose of its' intentions, and if, as previously failed nail clipper safety attempts show us, the final result is that consumers en masse still remain without a true solution for the common two-blade vice style nail clipper depicted within this application, seeing no advancement of substance over the past one hundred and forty years, then no purpose has been served, and consumers en masse continue to be injured to this day because of previous industry failure. By providing a small, ergonomic, nearly undetectable-at-first safety-solution for the preferred two-blade vice-style nail clipper, a novel advancement has been offered by the present invention.

More sanitary nail clipper: Expanding on the first aspect, the preferred embodiment of the present invention would certainly be a welcome option for those having to seriously consider nail cutting sanitation, disease spreading and or infections that may occur from a simple flesh cut or injury in people such as, but certainly not limited to, diabetics. To further expand on this, by reducing cuts and injuries in nail salons, for example, it could be logically understood that the odds for infections would go down. It would be logical to assume that the less a nail clipper's blade parts touch an end-user, the chances of transmission go down as well. The present invention clearly offers a safer solution for those users and end-users concerned with infections caused by either an unnecessary amount of contact between nail clipper and skin, as with present failed safety solutions, or infections caused directly as a result of an actual cut or injury to flesh. The present invention offers a novel remedy for both circumstances.

Industry adaptability: Expanding on the first aspect, the preferred embodiment could be easily and affordably manufactured by a variety of methods and materials that are currently in use today. In the preferred embodiment said safety-cover-guard would be molded or pressed into shape at the same the lower body of the nail clipper was molded or pressed into shape, so as to be a permanent part and shape of the lower portion of a nail clipper, specifically, the safety-cover-guard and bottom portion of the nail clipper would be formed as one, at said time of initial formation. It is to be understand that a variety of manufacturing methods and materials could be used to attach or form said safety-cover-guard to a nail clipper's lower body, and that this is to be understood to be within the scope, intent and spirit of the present invention.

Industry Advancing: Expanding on the first aspect, the common two-blade vice-type nail clipper commonly found on store shelves today, that which is preferred by and used by consumers en masse, has remained unchanged for over one hundred and forty years, and to this day offers no safety protection what so ever. The present invention offers a novel remedy for a long-standing unsolved industry and consumer problem.

It was the Inventor's intent to offer consumers en masse a safety remedy designed specifically for their preferred, style of nail clipper, the common two-blade vice-type nail clipper; a safety solution that was ergonomic, user friendly, and, to the opposite extreme of cumbersome, unrecognizable and inefficient failed previous safety attempts, provide a safety solution so small that its' addition to a host nail clipper may not be noticed at first glance. With the present invention, the nail clipper can be brought into the twenty-first century, offering the most unique and efficient advancement to the nail clipper industry in over one hundred and forty years. It is worth noting who would most benefit from the present invention: those who have to cut other people's nails and have the stress and fear of injuring their child, patient or customer; and those who need to have their nails cut and possibly injured by someone other than themselves, such as but certainly not limited to infants, young children, elderly and handicapped patients, nail salon customers, and to be more specific:

a. Parents who stress over cutting their children's nails.

b. The children who are cut, injured and stressed by someone cutting their nails.

c. Nurses, hospice and homecare workers cutting their patient's nails.

d. The patients of those healthcare workers who are the ones receiving the injuries.

e. Manicurists cutting their customer's nails.

f. The customers of the manicurists, who are the ones receiving the injuries.

g. Children learning to cut their own nails for the first time.

h. Physically handicapped, nerve-damaged or sight impaired individuals who cut their own nails but perhaps do so with difficulties and limitations, often resulting in injury.

i. Anyone with a medical condition that negatively affects nail growth or nail shapes and/or seriously limits the space between the nail and the flesh and skin below the nail, making it difficult to cut such a nail without great effort and pain.

j. Anyone with a medical condition who may be at great risk of serious secondary infections as a result of being cut by a nail clipper, such as diabetics.

k. Hemophiliacs.

l. Anyone cutting the nails of a spouse, family member or friend as a loving gesture or if that person may just be temporarily incapable of caring for themselves.

m. Anyone wishing to use the safety-cover-guard merely as a helpful aid in not cutting their nails too short.

m. One specific example: A mother is cutting a child's nail, and accidentally cuts or otherwise injures the skin or flesh of said child's finger or toe. Beside the physical injury and considerable pain, said child often fears having their nails cut for a considerable period of time after said injury, possibly years. The parent or person doing the cutting is stressed about injury the child. This is an act of high anxiety for most parents and children, suffered repeatedly and needlessly throughout the years. Present invention offers a remedy not known before, and advances the nail clipper industry in a substantial way for the first time in one hundred and forty years. Consumers en masse would benefit from the present invention.

BRIEF DESCRIPTION OF DRAWINGS

While this invention has been described with respect to the preferred embodiment depicted in the drawings and descriptions within this application, still other modifications are possible. Such modifications should be deemed within the intent and spirit and scope of the present invention. Various preferred embodiments of the presently disclosed two-blade vice-style nail clipper comprising an angled safety-cover-guard with wrap-around edge protection are described herein with reference to the drawings, wherein.

DETAILED DESCRIPTION OF INVENTION

Figure 1:
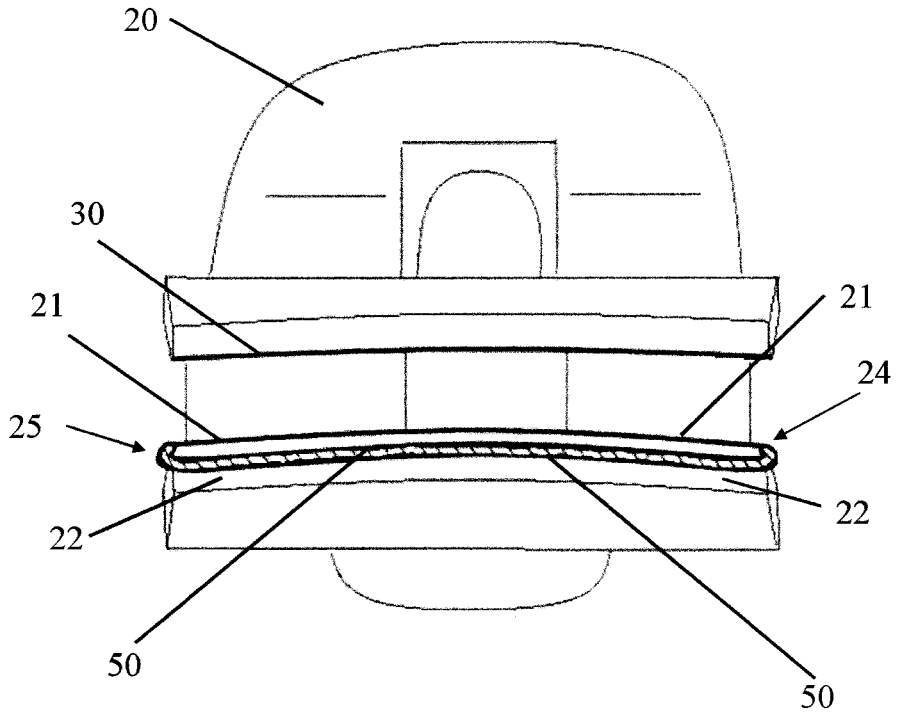
FIG. 1 shows an enlarged front-facing view of a two-blade vice-style nail clipper with the present invention, a safety-cover-guard, properly attached.

While this invention has been described with respect to the preferred embodiment depicted in the drawings and descriptions within this application, still other modifications are possible. Such modifications should be deemed within the intent, spirit and scope of the present invention. It should be understood that the present invention, a two-blade vice-style nail clipper comprising a safety-cover-guard as depicted in the preferred embodiment and described within this application could be made from any acceptable industrial material such as but not limited to stainless steel, steel, metals, plastic, synthetics or rubber, and that said safety-cover-guard could be attached to said nail clipper by any acceptable industrial method such as but not limited to pressing, molding, stamping, welding, gluing or bonding. It should also be understood that though the preferred embodiment of the present invention features a safety-cover-guard with a unique upward angle, that other angles or no angle may be possible or desired on any particular host nail clipper, depending on the design or physical shape and requirements of said host nail clipper, and would be within the intent, scope and spirit of the present invention. Accordingly, the description of a certain exemplary embodiment should not be deemed to limit the scope of the present invention.

FIG. 1 is a front facing view showing the general shape and appearance of the preferred embodiment, a common two-blade vice-type nail cutter 20 with a thin bumper-shaped safety-cover-guard 50 in place. Said safety-cover-guard 50 follows the shape of said nail clippers lower cutting blade 21, and is permanently attached to said nail clipper in the area 22 just below said lower cutting blade 21. Said safety-cover-guard 50 continues around said nail clippers sharp right-side corners and edges 25 and around said nail clippers left-side sharp corners and edges 24, offering a novel and unique level of protection from said right 25 and left 24 sharp sides, edges and corners that often cause injuries during the nail cutting process, especially when said nail clipper 20 needs to be used at a less common, more dangerous angle (shown in FIG. 8). Being so thin, said safety-cover-guard 50 fits ergonomically and with minimal invasiveness between a finger nail and the vulnerable flesh below said finger nail (shown in FIG. 13), which uniquely allows the present invention to provide maximum protection with minimal or no contact with human flesh. When viewing a preferred embodiment from top, bottom or front views, said safety-cover-guards 50 upward angle would be barely noticeable, if at all, but said upward angle is shown better in FIGS. 10 and 11. It is to be understood that a variety of angles, or no noticeable angle, may be appropriate depending on the host nail clippers physical and manufacturing specifics, but would be within the intent, scope and spirit of the present invention. For clarity, said nail clippers upper cutting blade 30 is depicted.

Figure 2:
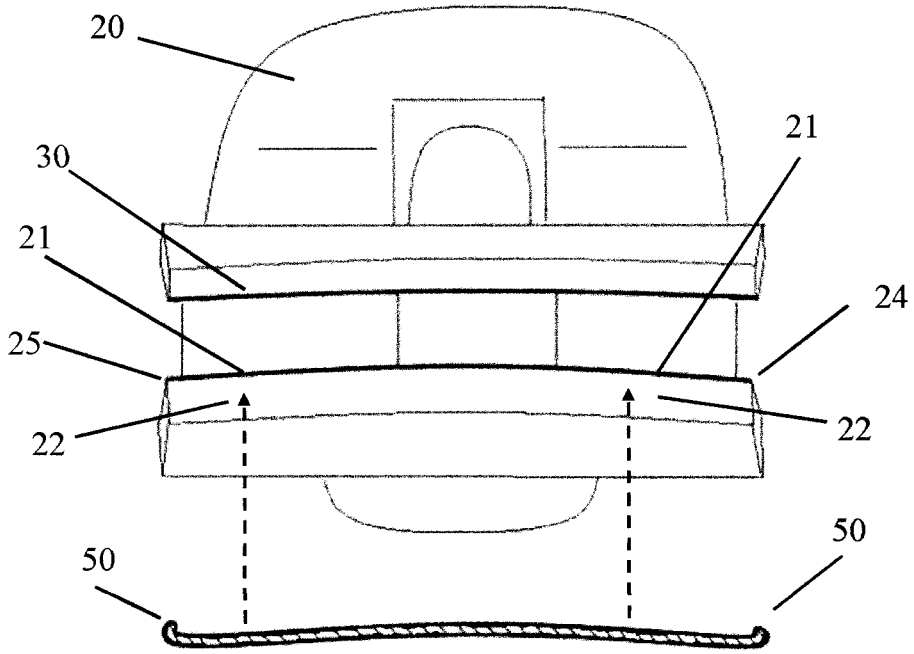
FIG. 2 shows how said safety-cover-guard would look prior to being attached to a nail clipper, and how said nail clipper would look without said safety-cover-guard in place.

FIG. 2 shows the same front view of said nail clipper 20 as in FIG. 1, but this time with said safety-cover-guard 50 removed from, or not yet attached to the area 22 below said nail clippers lower cutting blade 21. The unique design of said safety-cover-guard 50 takes on the general shape of a bumper, or mustache or handle bar, which allows the present invention to provide an end-user protection not only from the sharp front-facing lower cutting blade 21 areas, but also uniquely around the sharp sides, corners and edges of the left 24 and right 25 sides of said lower cutting blade 21. The upper cutting blade 30 is shown for clarity.

Figure 3:
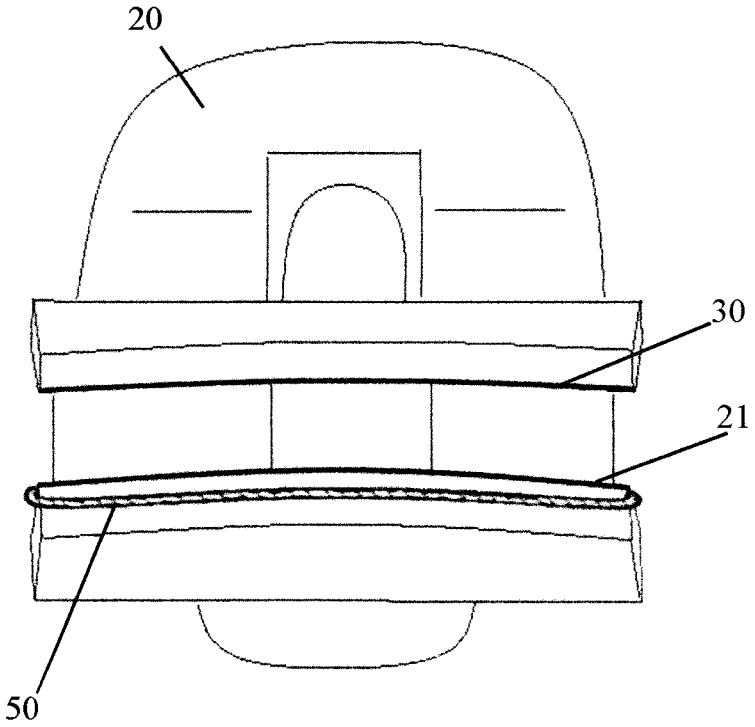
FIG. 3 shows the same nail clipper with safety-cover-guard as in FIG. 1 but with reduced part references for a clearer view of the general appearance of one preferred embodiment.

FIG. 3 shows the same front view of said nail clipper 20 as in FIGS. 1 and 2, but this time with less reference lines and numbers, so as to clarify and simplify the view of said safety-cover-guard properly 50 in place. We see said safety-cover-guard 50 attached below the lower cutting blade 21, and we see the upper cutting blade 30 for reference.

We can see that said safety-cover-guard 50 is thin and small, requiring an absolute minimum of design change to a standard two-blade vice-type nail clipper 20, almost to the point of being unnoticeable upon first glance, or if not highlighted in the drawings.

Figure 4:
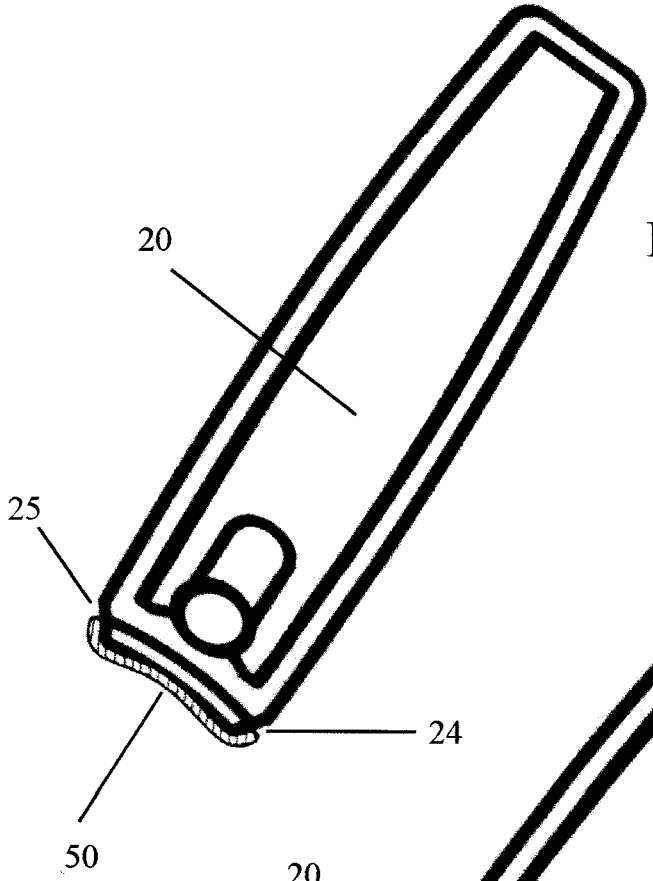
FIG. 4 shows an elevated top view of preferred embodiment as it may appear in its final form, with safety-cover-guard in place.

FIG. 4 shows an elevated top, front view of nail clipper 20, in one preferred embodiment, with said safety-cover-guard 50 properly in place or fully attached onto said nail clipper 20. In this figure we see how small said safety-cover-guard is in relationship to said nail clipper 20. A novel aspect of the present invention is its small size, allowing no or minimal contact with human flesh, and said safety-cover-guard's 50 unique wrap-around design which offers the unique remedy of providing an end-user protection from a nail clippers sharp left-side corners and edges 24 and sharp right sharp side corners and edges 25. That such an effective safety improvement could go unnoticed at first glance because of its small size is further proof of the present invention's novel and unique design.

Figure 5:
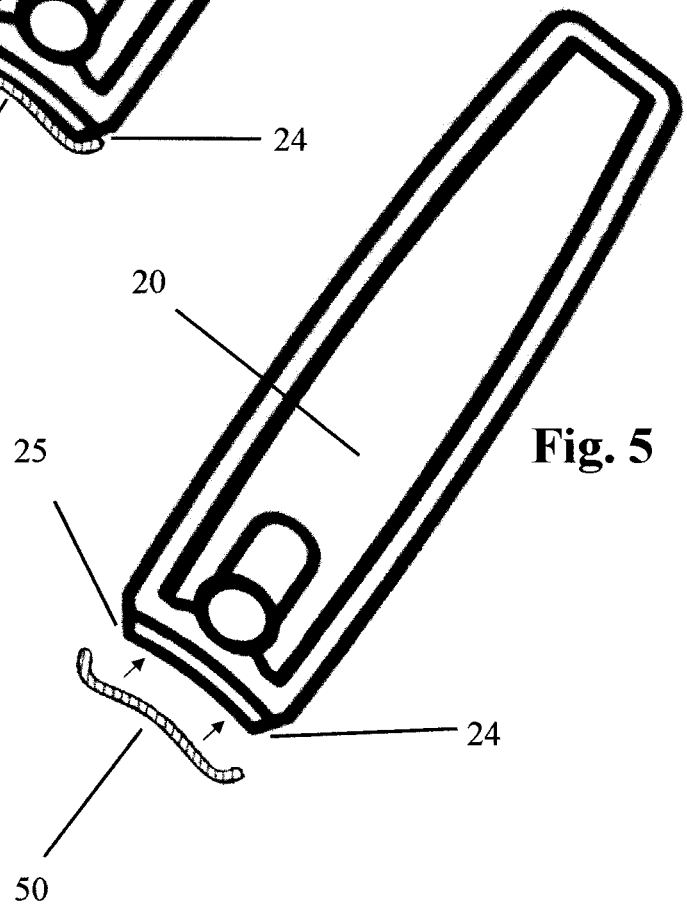
FIG. 5 shows an elevated top view of how safety-cover-guard would look prior to being attached to a nail clipper, and how said nail clipper would look prior to being fitted with said safety-cover-guard.

FIG. 5 shows the same elevated top, front view of nail clipper 20 as in FIG. 4, with said safety-cover-guard 50 as it would appear if it were not yet attached to said nail clipper 20, and how said nail clipper 20 would look prior to having said safety-cover-guard 50 attached to it. We can see that said nail clipper's left-side sharp corners and edges 24 and right-side sharp corners and edges 25 will benefit from said safety-cover-guard's 50 bumper or handlebar design, once said safety-cover-guard is placed into position, wrapping around those dangerous said sharp left-side 24 and right-side 25 corners and edges. Present invention provides consumers en masse a novel safety remedy not previously offered for the preferred common two-blade vice-style nail clipper 20.

Figure 6:
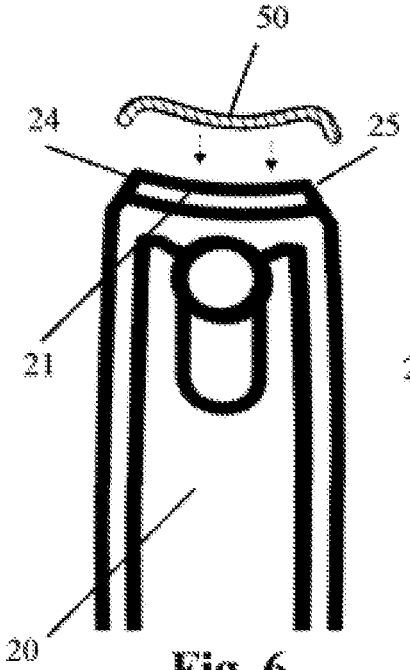
FIG. 6 is a top view and shows how safety-cover-guard would look prior to being attached to nail clipper, and how said nail clipper would look prior to having said safety-cover-guard properly attached.

FIG. 6 shows a top view of a nail clipper 20 in a preferred embodiment prior to having said safety-cover-guard 50 attached. This view shows how said safety-cover-guard 50 would appear prior to being attached to said nail clipper 20. We also see the sharp left side corners and edges 24 and sharp right side 25 corner edges as they would appear prior to having said safety-cover-guard 50 attached to said nail clipper 20. Said sharp corners and edges 24 and 25 of said nail clipper 20 cause many cuts and injuries. The unique design of said safety-cover-guard 50 provides a remedy for this problem, as shown in FIG. 8.

Figure 7:
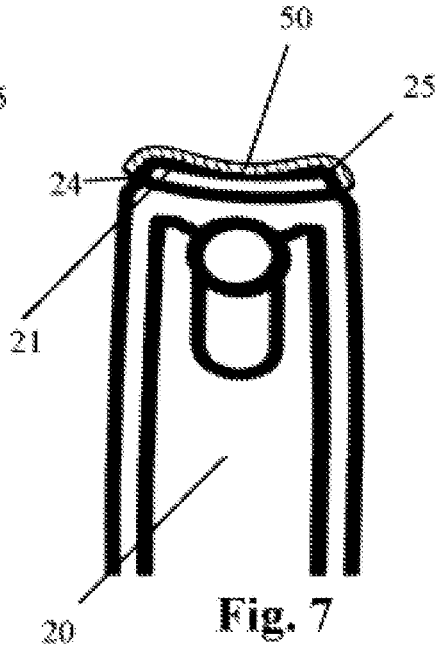
FIG. 7 is a top view showing safety-cover-guard properly attached to nail clipper.

FIG. 7 shows the same top view and nail clipper 20 depicted in FIG. 6, but this time with said safety-cover-guard 50 in place, as it would appear when properly attached to said nail clipper 20. Said nail clipper's 20 sharp left side, corner and edge 24 and sharp right side, corner and edge 25 are now safely neutralized by said safety-cover-guard's 50 unique wrap-around remedy.

Figure 8:
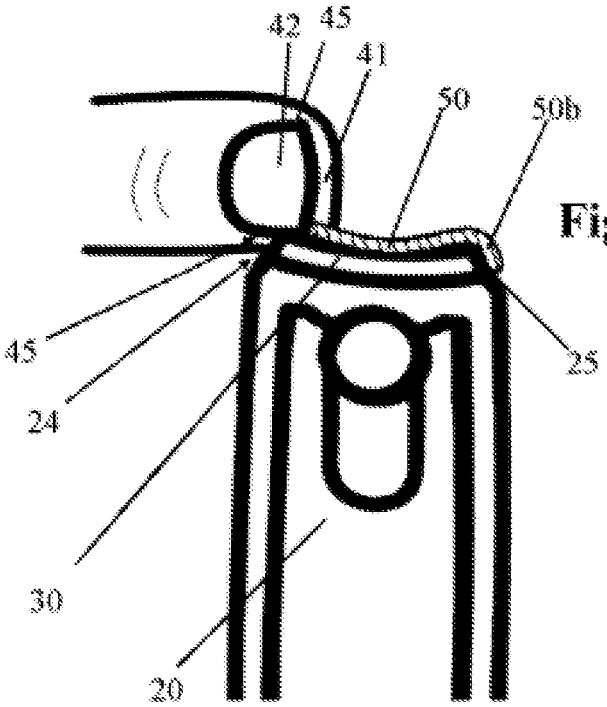
FIG. 8 is a top view of nail clipper cutting a fingernail at a difficult corner angle, showing how safety-cover-guard protects an end-user even in a most difficult nail cutting angle by curving around the dangerous and sharp sides, edges and corners of said nail clipper.

FIG. 8 shows the same top view and nail clipper 20 as in FIGS. 6 and 7, and shows how said safety-cover-guard's 50 unique wrap-around shape provides a novel level of safety protection for a finger's lateral nail folds 45, and how said safety cover-guard can pry a difficult nail upward and simultaneously place said nail clipper's blades into proper cutting position, a remedy previously not known. Even when cutting at difficult angles, or when cutting difficult nails, or areas of a finger nail 42 where it would be necessary to tilt a nail clipper 20 at an angle, said safety-cover-guard 50 would provide the same degree of safety due to said safety-cover-guard's 50 unique wrap-around design. Also shown is how said safety-cover-guard 50 fits above the fingertip 41, and can be ergonomically positioned to safely cut near said finger nail's lateral nail fold 45 with said nail clipper's upper cutting blade 30 in position to make a cut. This is a revolutionary advancement for cutting near the lateral nail folds 45. We also see that the sharp left corner and edge 24 of said nail clipper 20 would normally be in a position to easily cause injury if said safety-cover-guard 50 was not attached. Thus, the novel design of said safety-cover-guard 50 provides an end-user with a level of lateral nail fold 45 protection not previously known. By viewing the opposite side of said safety-cover-guard 50*b*, we can see said nail clipper's 20 right sharp corners and edges 25 safely neutralized by the wrap-around design of said safety-cover-guard, and this is the same neutralization that is currently happening on the left sharp corners and edges 24 currently not seen as they are beneath said nail 42. Present invention's unique design and thinness allow for protection to be provided regardless of what angle a nail clipper 20 is needed to be held at. Also of significance is we can see how said safety-cover-guard 50 can be used to pry under a nail 42, and automatically and simultaneously place said nail clipper 20 into cutting position. This is done in one motion. The safety-cover-guard pries under the nail, and the nail clipper automatically ends up in perfect cutting position for that particular cut. This is a novel feature and advancement of the present invention.

Figure 9:
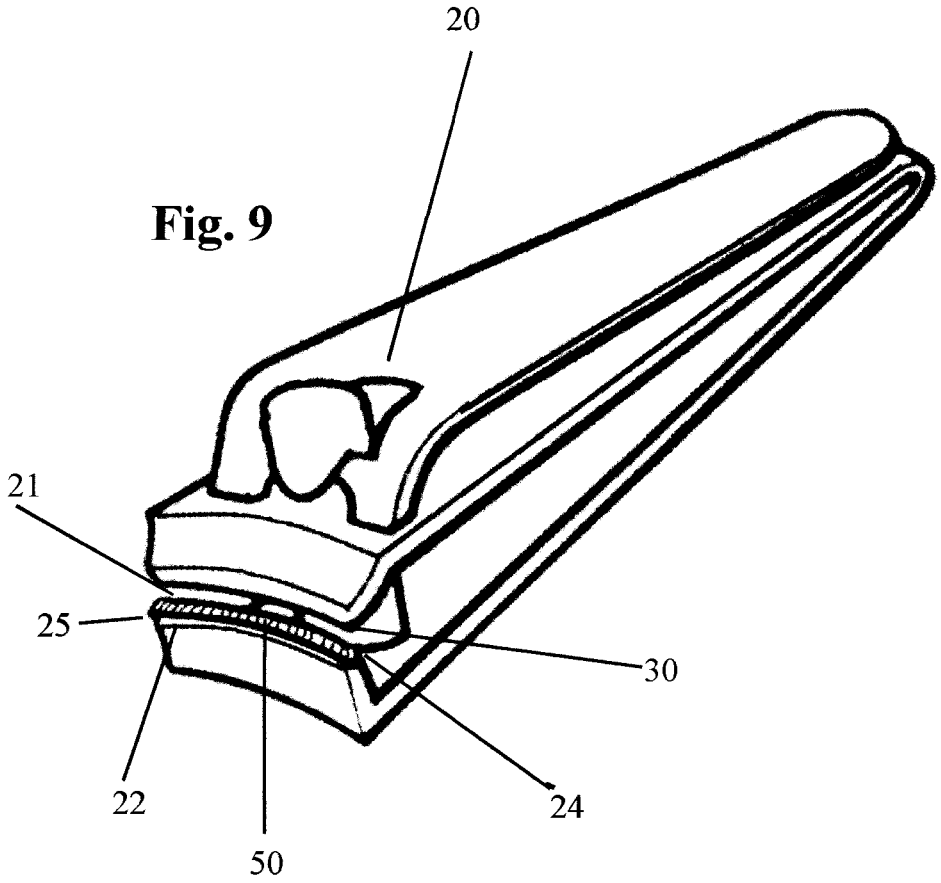
FIG. 9 is a slightly elevated front and side view, showing an additional view of how a nail clipper would look with a safety-cover-guard properly attached.

FIG. 9 shows an elevated front, side and top view for the purpose of showing another angle of how a nail clipper 20 may appear with a safety-cover-guard 50 attached. Said safety-cover-guard 50 is mounted in the area just below said nail clipper's lower cutting blade 21, and wraps around said nail clipper's 20 left side sharp corners and edges 24 and right side sharp corners and edges 25. Also shown is said nail clipper's top cutting blade 30. This figure shows that a thin, minimally invasive safety-cover-guard 50 leaves might be unnoticed at first glance, which is part of said safety-cover-guard's 50 uniqueness. The present invention has made substantial safety improvements with minimal change to the popular two-blade vice-style nail clipper 20.

Figure 10:
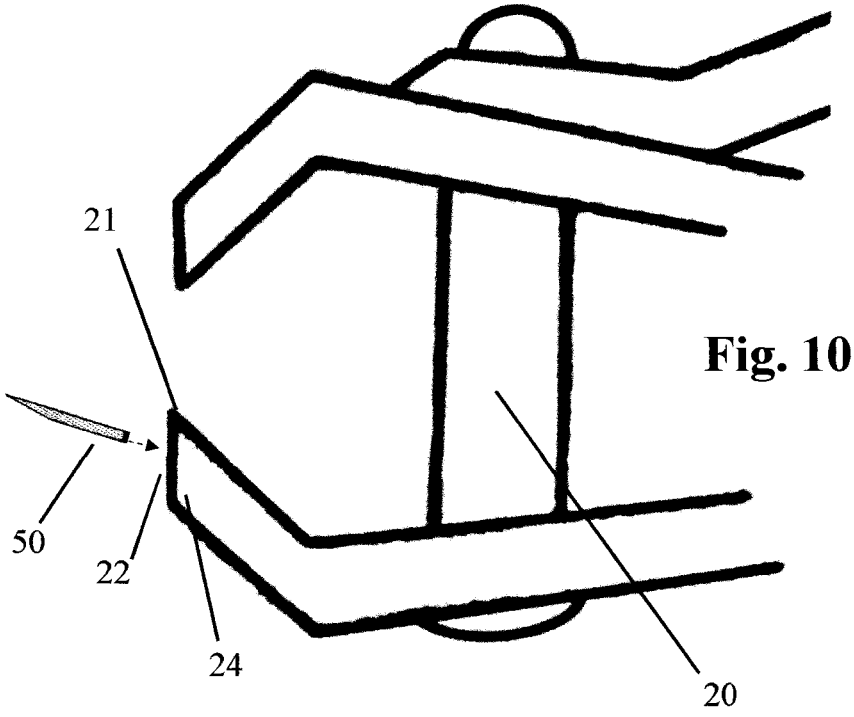
FIG. 10 is a simplified side view showing upward angle of thin safety-cover-guard, and said safety-cover-guard prior to being attached to a nail clipper.

FIG. 10 is an enlarged simplified side view showing said safety-cover-guard 50 as it would appear prior to being attached to a nail clipper 20, and how said nail clipper 20 would look prior to having said safety-cover-guard 50 attached. The area 22 just below said nail clipper's lower cutting blade 21 is where said safety-cover-guard 50 would be attached. By strategically placing said safety-cover-guard 50 below said lower cutting blade 21, said safety-cover-guard 50 can now be slightly angled upward, which allows said safety-cover-guard 50 to provide several unique functions and benefits described herein. We also see the left side sharp corner and edge 24 said nail clipper 20 exposed and able to cause injury.

Figure 11:
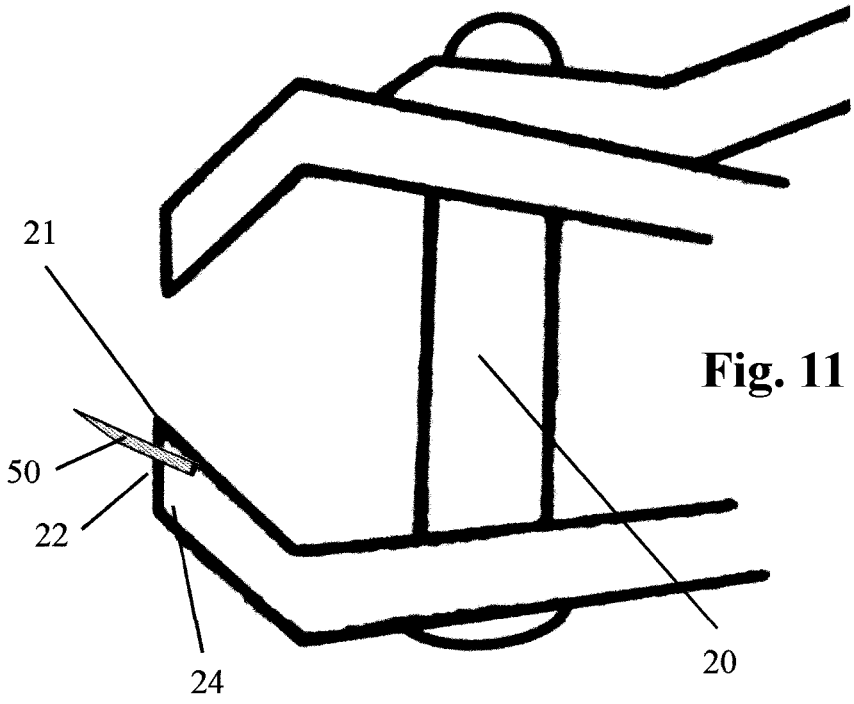
FIG. 11 is a simplified side view showing thin angled safety-cover-guard properly in place, and showing how said safety-cover-guard's wrap-around design protects end-users from a nail clipper's dangerous sharp edges and corners.

FIG. 11 is the same enlarged simplified side view as in FIG. 10 but now with said safety-cover-guard 50 properly attached to said nail clipper 20, and physically neutralizing said nail clipper's left side sharp corner and edge 24, one of several unique remedies provided by the present invention. This view also shows where said safety-cover-guard 50 would be attached in the area 22 just below said nail clipper's lower cutting blade 21. Attaching said safety-cover-guard 50 in said lower area 22 allows room for said safety-cover-guard 50 to be placed at a novel and strategic upward angle.

Figure 12:
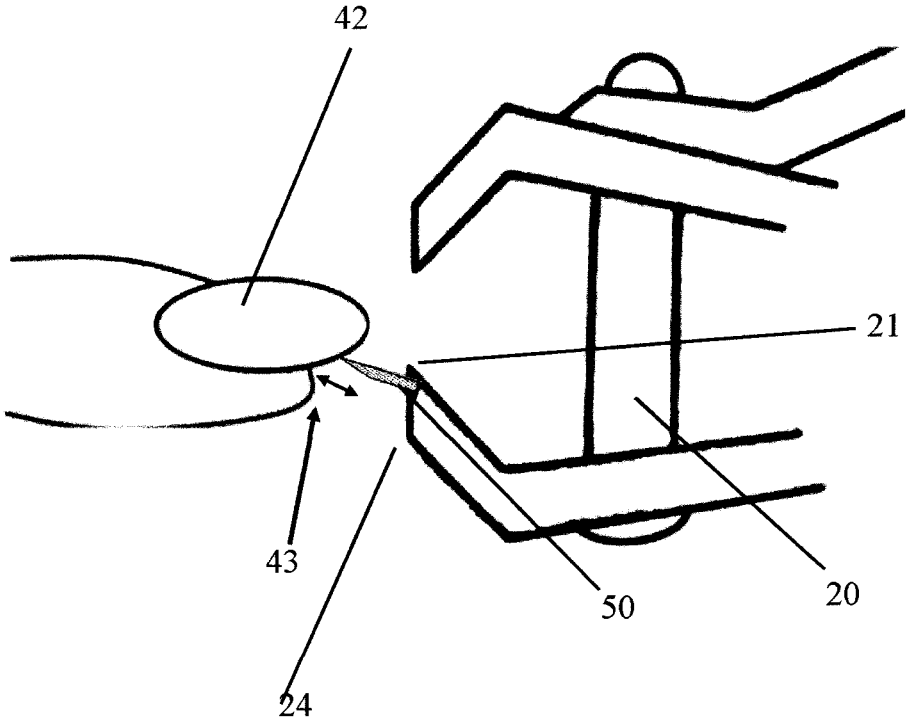
FIG. 12 is a simplified side view of nail clipper with angled safety-cover-guard prior to placing said safety-cover-guard underneath the fingernail.

FIG. 12 shows the same enlarged simplified side view as in FIGS. 10 and 11, with said safety-cover-guard 50 properly attached to said nail clipper 20. We see the curvature of a fingertip 43, and how said safety-cover-guard's 50 upward angle allows for ergonomic, minimally invasive placement above said fingertip 43 and the vulnerable flesh below a finger nail 42. Vulnerable flesh below said nail 42 and above said fingertip 43 would be ergonomically covered or blanketed, not physically pushed or shoved away, and thus isolated away from said nail clipper's sharp cutting blade 21. One of several unique advantages to said safety-cover-guard 50 is the ability to protect an end-user's vulnerable flesh from injury with little or no contact with flesh.

Figure 13:
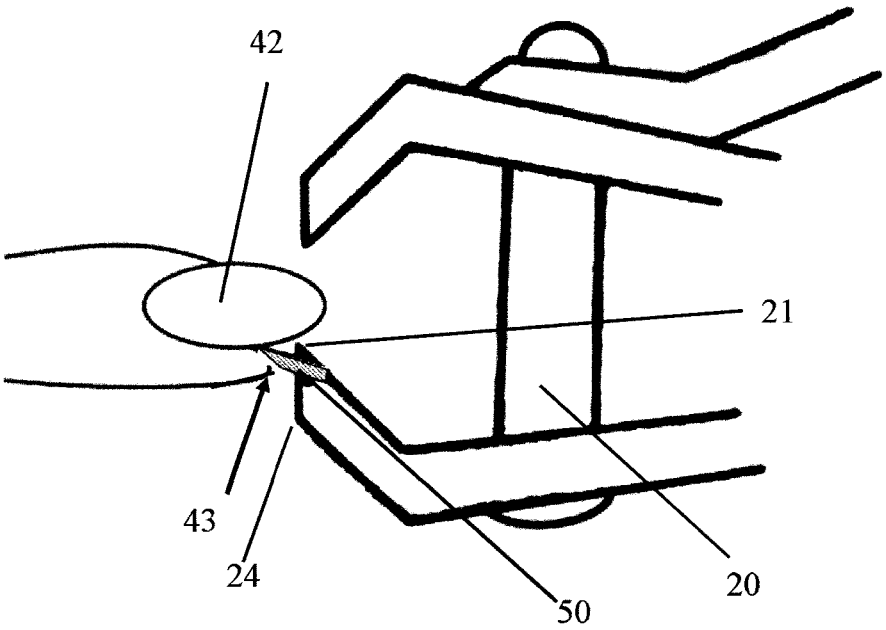
FIG. 13 is a simplified side view of nail clipper with angled safety-cover-guard placed above the flesh found right below a finger nail, and below said nail.

FIG. 13 shows the same enlarged simplified side view as in FIGS. 10, 11 and 12, but moves forward in time from FIG. 12 in that said safety-cover-guard 50 is now properly in place under an end-users nail 42 and ready for the nail cutting process to begin. We can see how said nail clippers lower cutting blade 21 has been isolated from any vulnerable flesh with minimal invasiveness but maximum efficiency, and thus unable to cause injury. A blade cannot cut what it cannot touch. We also see from this same angle how said safety-cover-guard 50 can pry under said nail 42 and automatically and simultaneously situate said nail clipper 20 into cutting position, in one motion, without the need of another tool such as a file. This is a novel feature of the present invention.

What is claimed is:

1. A two-blade vice-style nail clipper comprising:

a first blade and a second blade;

the first blade comprising a curved edge, a first corner portion at one end of the curved edge, a second portion at the other end of the curved edge, the curved edge having a concave shape when viewed from above the first blade;

a cover guard coupled to the nail clipper at an area just below the first blade;

the cover guard being in the form of a single strip that has a first end and a second end;

the single strip having a cross section that corresponds to a shape of the first blade;

the single strip comprising a curved portion that corresponds in shape and size to the curved edge of the first blade;

the single strip comprising a first edge portion at the first end and corresponding in shape to the first corner portion of the first blade;

the single strip comprising a second edge portion at the second end and corresponding in shape to the second corner portion of the first blade;

the cover guard being coupled to the nail clipper at the area just below the first blade by one of molding, pressing stamping, welding or gluing; and the curved portion of the single strip having an edge spaced from the curved edge of the first blade.

2. The two-blade vice-style nail clipper of claim 1, wherein:

the cover guard projects from the two-blade vice-style nail clipper to cover flesh under a nail of a user during a nail cutting process.

3. The two-blade vice-style nail clipper of claim 1, wherein:

the cover guards projects from the two-blade vice-style nail clipper to pry a nail upward while simultaneously placing the two-blade vice-style nail clipper into a proper cutting position.

4. The two-blade vice-style nail clipper of claim 1, wherein:

the cover guard projects from the two-blade vice-style nail clipper to clean under a nail of a user.

5. The two-blade vice-style nail clipper of claim 1, wherein:

the cover guard projects from the two-blade vice-style nail clipper to prevent cutting into a portion of a user's finger nail or toe nail.

6. The two-blade vice-style nail clipper of claim 1, wherein:

the cover guard comprises at least one of stainless steel, steel, metals, plastic, synthetics and rubber.

7. The two-blade vice-style nail clipper of claim 1, wherein:

the edge of the curved portion of the single strip is approximately level with the curved edge of the first blade.

* * * * *